US009215932B2

(12) United States Patent
Birkbeck

(10) Patent No.: US 9,215,932 B2
(45) Date of Patent: Dec. 22, 2015

(54) SLIDE CHAIR ACTION

(76) Inventor: Hilary Rolf Birkbeck, Fenny Compton (GB)

( * ) Notice: Subject to any disclaimer, the term of this patent is extended or adjusted under 35 U.S.C. 154(b) by 181 days.

(21) Appl. No.: 13/821,124

(22) PCT Filed: Sep. 2, 2011

(86) PCT No.: PCT/GB2011/051656
§ 371 (c)(1),
(2), (4) Date: Sep. 23, 2013

(87) PCT Pub. No.: WO2012/032336
PCT Pub. Date: Mar. 15, 2012

(65) Prior Publication Data

US 2014/0103689 A1 Apr. 17, 2014

(30) Foreign Application Priority Data

Sep. 8, 2010 (GB) ..... 1014953.2

(51) Int. Cl.
*A47C 1/032* (2006.01)

(52) U.S. Cl.
CPC ..... *A47C 1/03255* (2013.01); *A47C 1/03277* (2013.01); *A47C 1/03294* (2013.01)

(58) Field of Classification Search
CPC ..... A47C 1/03255; A47C 1/03277; A47C 1/03294
USPC ..... 297/300.1, 300.2, 300.7, 300.5, 316, 297/317, 318
See application file for complete search history.

(56) References Cited

U.S. PATENT DOCUMENTS

| | | | | |
|---|---|---|---|---|
| 4,966,411 | A | 10/1990 | Katagiri et al. | |
| 5,931,531 | A * | 8/1999 | Assmann | 297/316 |
| 6,641,214 | B2 * | 11/2003 | Veneruso | 297/322 |
| 6,709,056 | B2 * | 3/2004 | Bock | 297/300.4 |
| 6,896,329 | B2 * | 5/2005 | Sander et al. | 297/316 |
| 6,905,171 | B2 | 6/2005 | Knoblock et al. | |
| D536,890 | S | 2/2007 | Loew et al. | |
| 7,188,900 | B1 | 3/2007 | Raftery | |

(Continued)

FOREIGN PATENT DOCUMENTS

| | | |
|---|---|---|
| CA | 2446654 | 4/2005 |
| CA | 2492759 | 7/2006 |

(Continued)

OTHER PUBLICATIONS

Tun Yu, "SA-9000" chair adjustment mechanism technical sheet. Publication date unknown.

(Continued)

*Primary Examiner* — David R Dunn
*Assistant Examiner* — Timothy J Brindley
(74) *Attorney, Agent, or Firm* — Dickinson Wright PLLC

(57) ABSTRACT

A chair action features a movable seat frame (11), a drive frame (12) for effecting seat frame movement, and an underpinning yoke frame (13), intervening pivot slides operative between frames, with guideway slots (14, 14, 16) and followers (19) variously in frames, to contrive a combined pivot swing and translational slide action, and free-floating seat frame mobility, while conforming to virtual pivot geometry; operable under a potential energy function in an inter-relationship between back recline and seat movement, for a common or harmonious experience between different occupancy weights.

16 Claims, 12 Drawing Sheets

(56) References Cited

U.S. PATENT DOCUMENTS

| | | | | |
|---|---|---|---|---|
| 7,611,202 | B2 | 11/2009 | Johnson et al. | |
| 7,806,478 | B1 * | 10/2010 | Cvek | 297/300.1 |
| 8,528,973 | B2 * | 9/2013 | Sander et al. | 297/303.1 |
| 8,662,586 | B2 * | 3/2014 | Serber | 297/316 |
| 8,939,509 | B2 * | 1/2015 | Ni | 297/303.4 |
| 2004/0075321 | A1 | 4/2004 | Sangiorgio | |
| 2004/0155502 | A1 | 8/2004 | Johnson et al. | |
| 2005/0146185 | A1 | 7/2005 | Fookes et al. | |
| 2005/0275265 | A1 | 12/2005 | Deimen et al. | |
| 2008/0084100 | A1 | 4/2008 | Curiger | |
| 2009/0146476 | A1 | 6/2009 | Kan et al. | |
| 2009/0152921 | A1 | 6/2009 | Johnson et al. | |
| 2010/0164263 | A1 * | 7/2010 | Malenotti | 297/300.1 |
| 2011/0074197 | A1 * | 3/2011 | Okamoto | 297/300.6 |
| 2011/0193384 | A1 | 8/2011 | Ni | |
| 2014/0028068 | A1 * | 1/2014 | Birkbeck | 297/340 |
| 2014/0077552 | A1 * | 3/2014 | Battey et al. | 297/300.1 |

FOREIGN PATENT DOCUMENTS

| | | |
|---|---|---|
| CN | 201602416 | 10/2010 |
| CN | 201630697 | 11/2010 |
| EP | 1987739 | 11/2008 |
| ES | 2347636 | 11/2010 |
| NL | 9002329 | 5/1992 |
| WO | WO 9315631 | 8/1993 |
| WO | WO 2008020824 | 2/2008 |
| WO | WO 2009153811 | 12/2009 |
| WO | WO 2010097818 | 9/2010 |

OTHER PUBLICATIONS

L&P. Office Components International, "LP02" chair adjustment mechanism technical sheet. Publication date unknown.

* cited by examiner

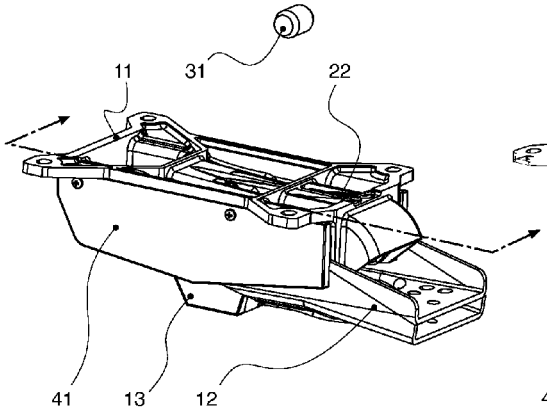
Figure 1A
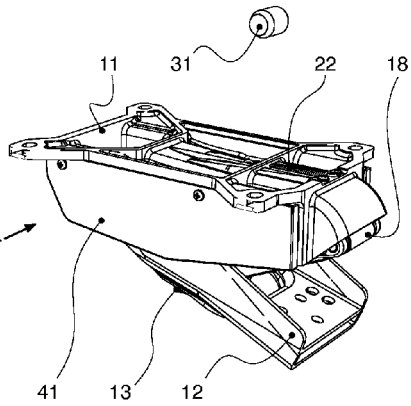
Figure 1A1
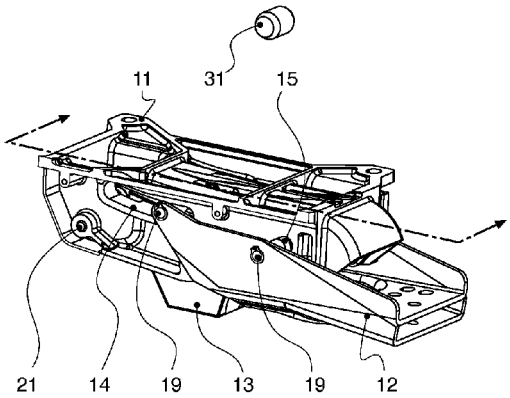
Figure 1B
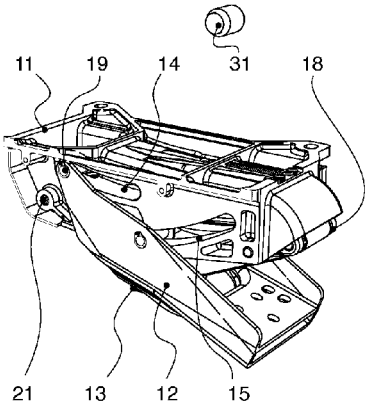
Figure 1B1
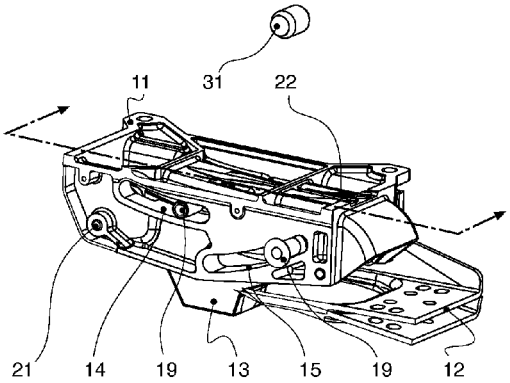
Figure 1C
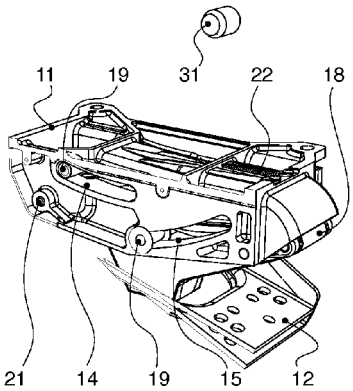
Figure 1C1

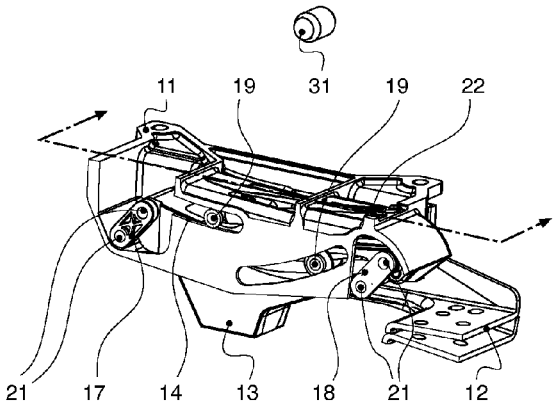
Figure 1D
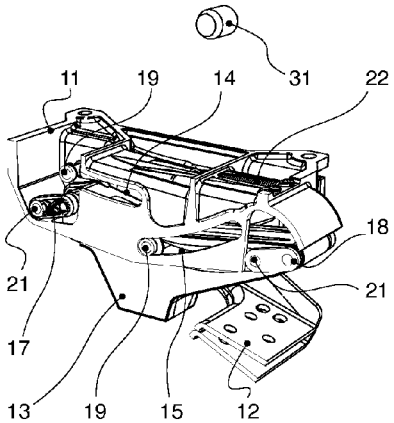
Figure 1D1
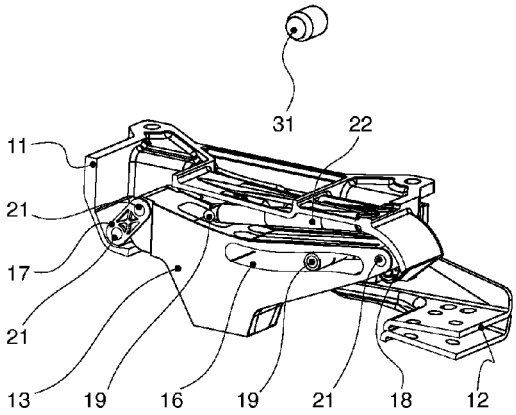
Figure 1E
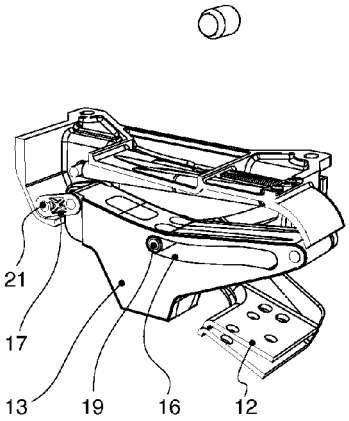
Figure 1E1

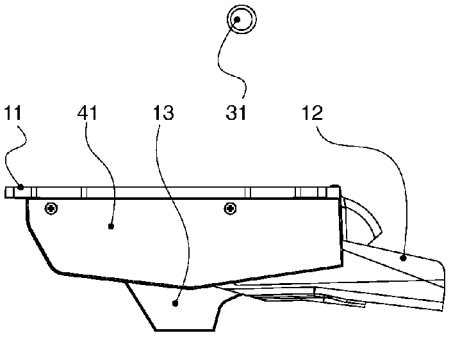
Figure 2A
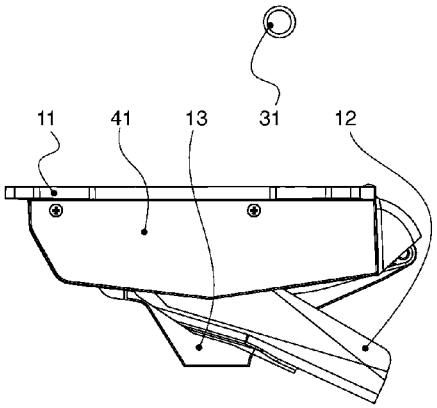
Figure 2A1
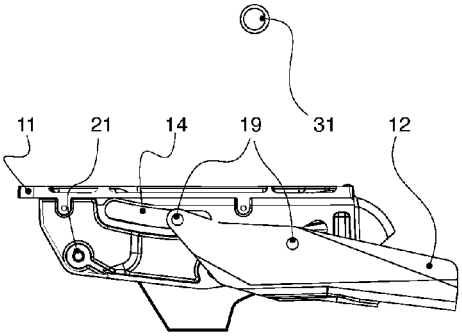
Figure 2B
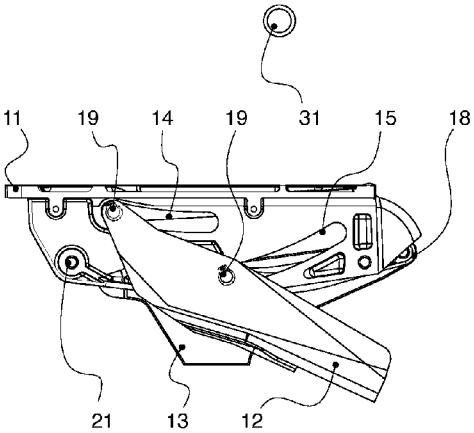
Figure 2B1
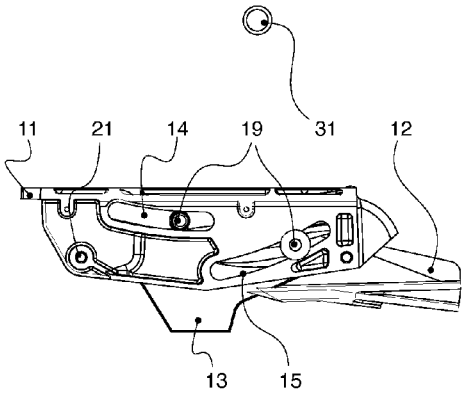
Figure 2C
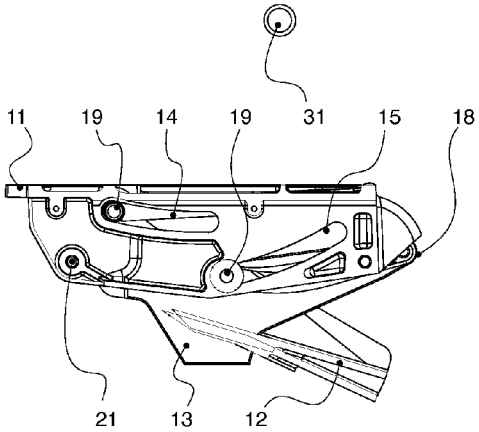
Figure 2C1

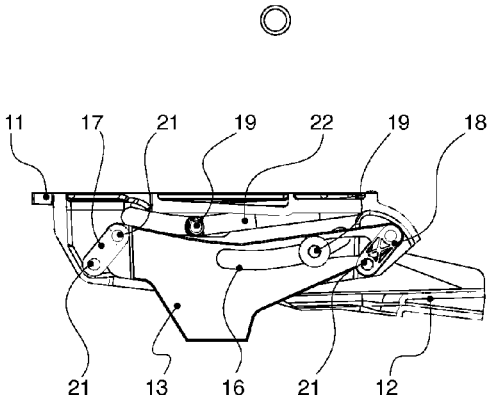
Figure 2D
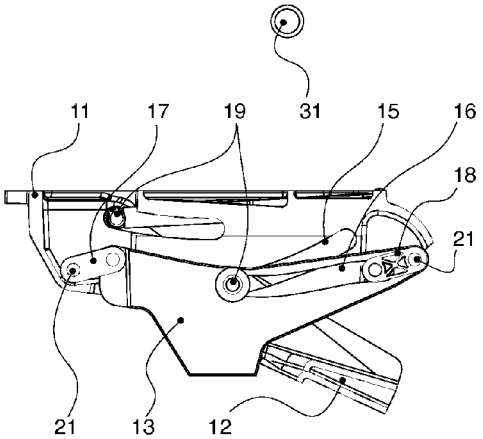
Figure 2D1
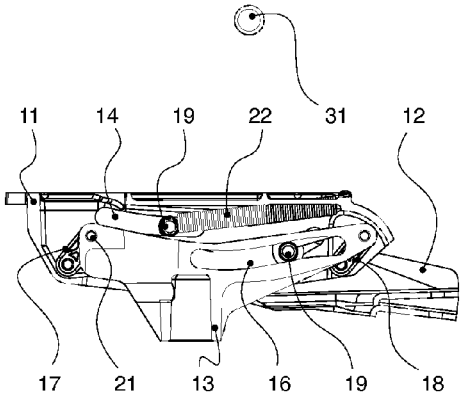
Figure 2E
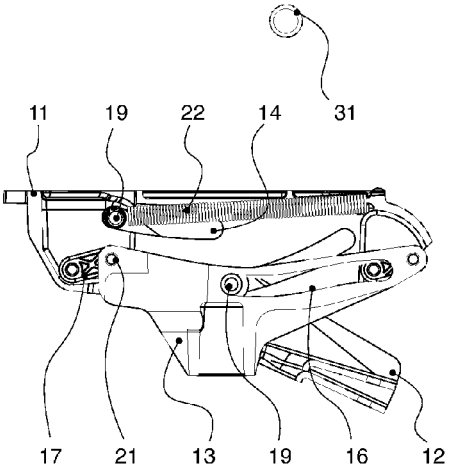
Figure 2E1

SLIDE CHAIR ACTION

CROSS REFERENCE TO RELATED APPLICATIONS

The present application is a national stage filing, pursuant to 35 U.S.C. Section 371, of International Patent Application No. PCT/GB2011/051656, filed Sep. 2, 2011, and through which priority is claimed to Great Britain Application No. 1014953.2, filed Sep. 8, 2010, the disclosures of which applications are incorporated herein by reference in their entireties.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION BY REFERENCE OF MATERIAL SUBMITTED ON A COMPACT DISC

Not applicable.

STATEMENT REGARDING PRIOR DISCLOSURES BY THE INVENTOR OR A JOINT INVENTOR

Not applicable.

FIELD OF THE INVENTION

This invention relates to chair actions and is particularly, but not exclusively, concerned with recliner chair to achieve a so-called 'Virtual Pivot' (VP) action; that is one unconstrained by the physical confines of a chair component and one consistent or harmonious with the natural pivot of a chair occupant body.

BACKGROUND OF THE INVENTION

Prior Art

Various proposals have been made for recliner chairs with seat and back mobility, but few if any to a VP agenda, and deficient in action and mechanical complexity and so cost. The Applicant has previously devised a VP action in WO2007/023301 which employed a 'distributed' 'L'-frame approach to reduce the bulk and intrusiveness of under-seat mechanism and allow freedom of (pedestal) mounting and in a later design has explored a multiple link arrangement in a co-operative chain or sequential array for more elaborate motion modes.

BRIEF SUMMARY OF THE INVENTION

Statement of Invention

In one aspect of the invention,
a chair action comprises
a seat frame (11),
a drive frame (12),
an inter-couple (14, 15, 16, 19) between seat and drive frames, a yoke frame (13) for chair mounting,
another inter-couple (17, 18, 21) between seat and yoke frames,
operable under a potential energy function
in an inter-relationship between back recline and seat movement,
for a common or harmonious experience between different occupancy weights.

In another aspect of the invention,
a chair action,
has a movable seat frame (11),
a drive frame (12) for effecting seat frame movement,
and an underpinning yoke frame (13);
intervening pivot slides operative between frames,
with guideway slots (14, 14, 16) and followers (19) variously in frames;
to contrive a combined pivot swing and translational slide action,
and free-floating seat frame mobility,
whilst conforming to a virtual pivot geometry
consistent with occupant natural body pivot.

Generally, a mixed element mechanism, designated for ease of reference as a 'slide' to reflect a principal element, uses a combination of (predominantly) bespoke profiled or contoured elongate slots (tracks, grooves, pathways or guideways) and followers. The guideways can have complex curvilinear and overlapping guide path profiles or pathways, with abrupt transitions, even local discontinuities, to impart temporary resistance. This is reflected in subtlety and complexity of attendant motion through followers transitioning the guideways. So a guideway path could be regard as a form of 'hard' 2-D profile or 3-D contour map for passive exploration by followers.

Guideway profile is effectively a form of 'executable' analogue program, which dictates or at least impacts upon component mobility to a prescribed pathway and thus chair action 'output', such as seat slide and elevation or tilt, to a certain 'input' such as occupancy and back recline. A substitution of the guideway element with another profile or another guideway routing, effectively achieves a program change. If desired, a guideway can impart a degree of 'soft compliance', flexibility or 'give' in chair action.

A broad consideration is subtlety or complexity in chair action, but without undue complexity in components or inter-couple That could be regarded as a 'leveraged programmable value' outcome. That is a disproportionately greater output value for a relatively modest input effort or cost. Rather than necessarily having to change components for a guideway change, multiple alternative guideways could be incorporated in a given component, with an appropriate guideway used upon assembly. A segmented, multiple alternative pathway rail track split, bifurcation, cross-over or points changeover might even be fitted for guideway change selection.

Slides or guideways alone can prove unpredictable and unstable in variability for motion control. To address this, slides can be used as a primary motion control in conjunction with a secondary 'disciplinary' element, such as links, most likely with fixed relative pivot axis dispositions. Links with movable pivots might be contemplated, but would be more challenging to avoid inadvertent lock-up or jamming. Links conveniently take the form of swing or pivot arms, such as arms pivoted at opposite ends to different elements, and help stabilise, control or 'discipline' the action. Links can be regarded as a subsidiary ancillary element to motion control.

As a prime geometry constraint, seat and back can rotate largely, but not wholly, independently about a common notional VP axis, in common with the body of a chair occupant. This to provide reassurance, compliance and comfort. A locus of movement of an occupant body pivot can be replicated or followed in a chair action by harmony with mechanism VP locus.

A slide rationalises the number of elements and moving parts, whilst preserving flexibility in action freedom by admitting a certain compensatory adjustment, to allow a certain 'informality' in mounting and drive tolerance, slackness, or 'slop'. Put another way, a slide allows a greater overall collective freedom of movement and a more complex action or motion profile; with blurred boundaries or 'fudge'. More simply, a slide can impart 'compliance' with a target motion. A potential awkward or obstructive action in one area is relieved and compensated for in other areas. The action accommodates motion combinations for elements, which might otherwise come into mutual conflict and even jam or impede movement. Use is made of multiple individual guideway profiles of curvilinear form and their co-operative relative disposition.

The collective (movement) action is two-fold:

A. to control the interaction of principal chair elements (e.g. back and seat);

B. to control the movement in space of principal chair elements (e.g. back and seat);

this movement action is in relation to a static reference or ground plane; represented, in the case of a pedestal chair, by an underpinning frame, configured as a yoke with spayed arms about a stem collar. For a side chair a base frame supported by corner legs could serve as an underpinning support.

Considerations 1. to allow the seat frame to apparently 'ride' or 'float' freely, (in relation to a ground or reference plane) in the perceptions of a ('chair-borne') seat occupant.
2. to impart 'reassuring' resistance to (initial and/or ongoing) back recline, by (reciprocal) counteraction with, or 'see-saw' counterbalance by, (imposed) occupant weight.
3. to achieve a (counter-) balance pivot 'consistent' or 'harmonious' with (an effective) natural body pivot, taking account of upper and lower trunk body mass distribution, as perceived by a chair occupant.
4. geometrically, a seat pivot complementary to, or consistent or coincident with back pivot.
5. to create a modest incremental forward and upward seat transition, upon/driven by back recline.
6. to keep the seat rear to lower back junction from coming together and 'pinching' an occupant; but to preserve a consistent seat inclination.
7. to provide support and 'constrained' mobility, within bounds.
8. a 'seamless' if not 'effortless' (or minimal effort) responsive, movement upon demand, gives an occupant a relaxed control; with constraints against sudden unstable modes or behaviour.
9. reaction bias springs can slow, calm, temper or dampen movement in response to user demand.
10. a modest return bias action allows an automatic return to an un-displaced condition, whilst allowing some neutral interim balance, or neutral stability, between back and seat mobility and affording occupant feedback of reassurance through resistance to input.

Characteristics 1. a minimal number of principal elements;
2. principal elements 'mutually contained'; thus say, a seat frame sat astride ('static') yoke frame, but within the 'embrace' or span of a back frame.
3. (a pair of) longitudinally offset guideways in a seat frame traversed by respective followers carried by drive arm or frame.
4. certain followers also traverse guideways in the yoke frame.
5. swing arms or pivot links between yoke frame and seat frame, grouped (e.g. paired longitudinally) with fixed relative pivot disposition, to help stabilise, discipline or constrain mobility.
6. a key or lead 'design driver or criterion' is a 'virtual pivot' action; i.e. commonality or harmony of seat and back combined pivots, along with 'natural body (effectively combined upper and lower trunk) pivot', outside the physical confines of the frames.

Analysis

For analysis, with simplified role categorisation, the idea and terminology of 'reaction' or 'reactive' frames are introduced. Thus a reaction frame is (or can be defined as) one against, or in relation to which, other frames are displaced. Reaction frames (as a group or category) could be classified or ranked, in a hierarchy, of primary, secondary or beyond, according to whether or not they are stationery/fixed, or themselves mobile. More specifically, a 'primary' reaction frame, in practice is likely to be a static ground or reference frame, such as the yoke frame for a pedestal chair mechanism. Whereas a secondary reaction frame, whilst also one against, or in relation to which, other frames are displaced; is itself displaceable in relation to a primary frame. Thus, say, for a seat frame displaced in relation to a yoke frame, the yoke would be a primary frame. However, for a seat frame displaced in relation to a drive frame, the drive frame would be a secondary frame; this would reflect the intermediary role of the drive frame.

The instigator of action, from a neutral upright position, is primarily back tilt or recline upon occupancy. In some of the Applicant's past work, the mere act of occupancy or seat loading displaced or 'settled' the seat or seat-to-back interconnection downward as a preparatory reaction. This allowed setting of the seat ramp incline—against which back tilt drove the sea upward and forward. In a fresh approach, a coupling (e.g. cam driver displacement) interface between back and seat can have this 'setting mode' effect, by altering the mechanical advantage, leverage or 'purchase' of back motion over seat displacement. That leverage can vary over a travel range with a cam action profile lever end profile. The purchase or pivot inter-couple point of back in relation to a support and/or seat frame can reflect occupancy. A seat to back inter-couple or an interaction interface between drive frame and seat frame, or an intermediary such as the yoke frame, can also reflect occupancy.

A universal setting or set-up, i.e. one which engendered a common action in space and occupancy experience (such as resistance to and pathway of recline), can be achieved by counter-balancing the (super-)imposed forces, such as the effect of occupancy weight under gravity upon seat slide motion against back tilt by rearward displacement of centre of gravity. A chair motion in harmony with an occupant body engenders a comfortable and reassuring occupancy sensation.

Potential Energy

Another conceptual approach, introduced for mathematical analysis of chair action and relative displacement of principal elements, and in particular the disposition in space of reaction frames, is that of 'potential energy' (PE) of PE function, as elaborated in the Appendix. This uses an indicative mechanism as a convenient starting point and reflects the effect upon occupancy mass under gravity at or in transition between different (seat) elevations. Such potential energy considerations could be assessed for displacement(s) in relation to primary frame(s) and/or a static ground frame of reference.

(Counter-) balance and stability considerations, either for an empty chair or under occupant loading, can be analysed for a 'see-saw', to-and-fro', or reciprocal mounting of principal frame elements about an intervening pivot. Input change forces, such as the imposition of occupant weight upon a chair seat, and occupant lean upon a chair back versus the output reaction or consequences in movement or re-disposition of seat (typically, slide but possibly also modest tilt or elevation) and back (typically, tilt or recline) can be assessed.

A formulaic or graphical geometric expression of action or behaviour, and attendant graphical plots, can be derived for analysis and prediction, as contributory design tools for occupant input action and chair mechanism reactive behaviour. Internal (slide and/or pivot) friction effects can also be considered. Iterative 'trial-and-error' design can be in relation to a target 'plot' of behaviour. Thus, say, slide pivot paths or pivot dispositions can be expressed and the consequences of changes mapped out. Different pivot positions and ranges of positions or pivot paths, can be tried as inputs and their effect upon the action assessed; the process being repeated, in a purposeful cycle of trial and error, until a desired (output) action has been achieved. Empirical or trial and error adjustments can be made in slide profile and disposition and link throw and pivot disposition using 3D CAD/CAM solid modelling software. Thus a VP geometry constraint can be imposed as a target, for any or all of seat, back and occupant disposition and tested for conformity over a range of back recline and attendant seat translations, elevations and inclinations. A fixed or variable ramp incline with (forward) translation can be used for seat motion Whilst pure or abstract pathway geometries can thus be mapped and explored, in practice, their mechanical implementation can introduce physical imperfections or obstructions, such as stiff and/or uneven travel, requiring appropriate tolerance and lubrication measures to resolve. Physiological 'reassurance' measures, such as initial resistance to recline motion, can be deliberately introduced, to help promote occupant perception of control.

BRIEF DESCRIPTION OF THE SEVERAL VIEWS OF THE DRAWINGS

Supporting Embodiment(s)

There now follows a description of some supporting embodiments of the invention, by way of example only, with reference to the accompanying diagrammatic and schematic drawings, in which:

FIGS. 1A through 2E1 are derived from solid modelling CAD/CAM programs, so are replete with overlaid detail, which may seem overly dense when rendered in black and white; hence the 3D and companion 2D versions and selective cut-away. These are supplemented by the more abstract versions of FIGS. 3A through 4C.

FIGS. 1A through 1E1 show a sequence of paired perspective 3D three-quarter views from one side of a recliner chair mechanism with VP geometry in back upright and recline positions, with inner component parts progressively more revealed sequentially as outer components are stripped back.

More specifically . . . .

FIGS. 1A through 1A1 show side perspective views of a an assembled chair mechanism in upright and tilt/recline positions respectively. 'Reaction' frames are obscured from view by a side and end cover plates.

FIGS. 1B and 1B1 show initial exposed side perspective views of the chair mechanism of FIG. 1A in upright and tilt/recline positions respectively. Part of a surmounting seat frame and side cover plate has been removed revealing a three distinct 'reaction' frames; an innermost primary static or yoke frame, with two overlying secondary frames for seat and back elements;

FIGS. 1C and 1C1 show a side perspective view of a chair mechanism of FIG. 1A in upright and tilt/recline positions respectively. The upright side arm of a back frame has been omitted to expose more detail of the seat frame, specifically the guideway and follower components are also now revealed to convey interaction with of seat and back frames.

FIGS. 1D and 1D1 show a side perspective view of a chair mechanism of FIG. 1A in upright and tilt/recline positions respectively, with outer part of a seat frame further stripped away, revealing the mechanism interaction between seat and yoke.

FIGS. 1E through 1E1 show a side perspective of a chair mechanism of FIG. 1A in upright and tilt/recline positions respectively, with the remainder of the seat frame side arm upright portion omitted to reveal the inner yoke to surmount hair pedestal base (not shown).

FIGS. 2A through 2E1 reflect 2D equivalents of the FIGS. 1A through 1E1 paired sequences, so will not be described individually in detail.

Figure 3A:
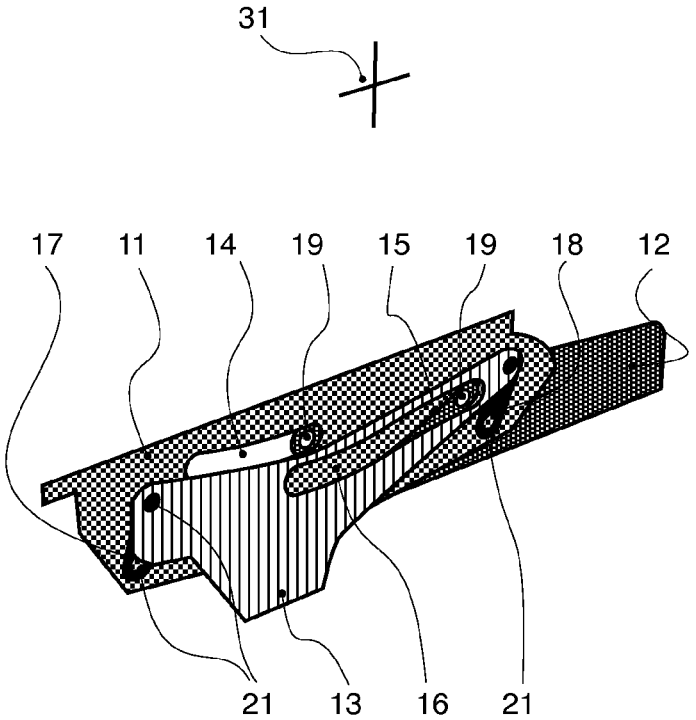
Figure 3B:
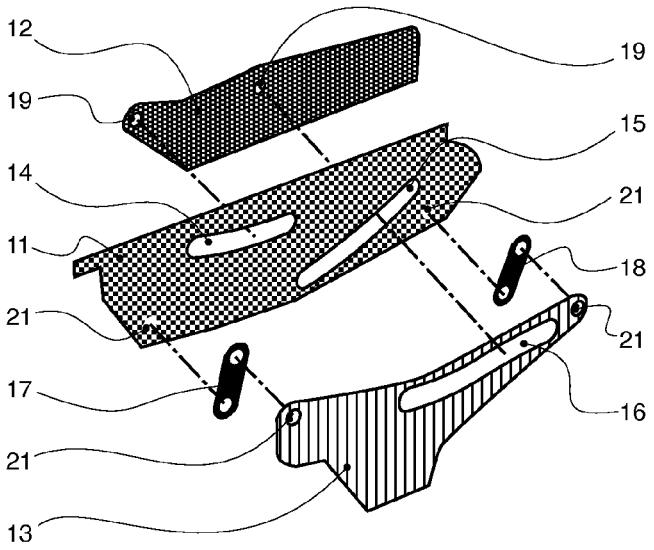

FIGS. 3A and 3B are notional simplified 3D topological abstractions of the mechanisms of FIGS. 1A through 2E1 for ease of comprehension of the disposition and interconnection of elements, with changes over a range of movement;

More specifically . . . .

Figure 4A:
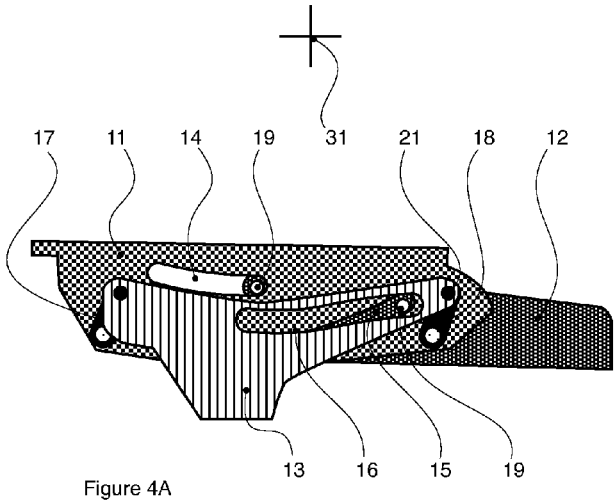
Figure 4B:
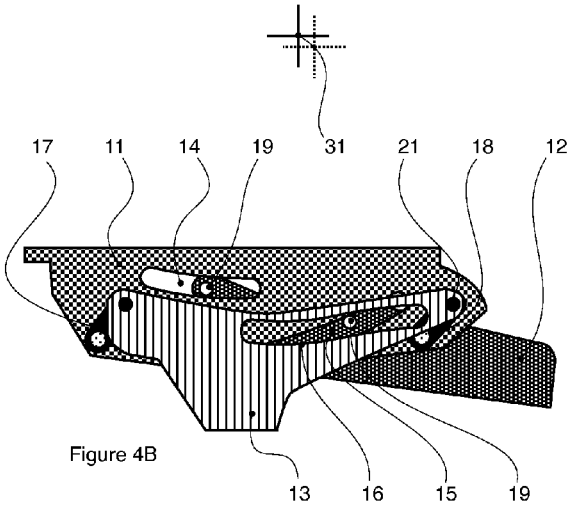
Figure 4C:
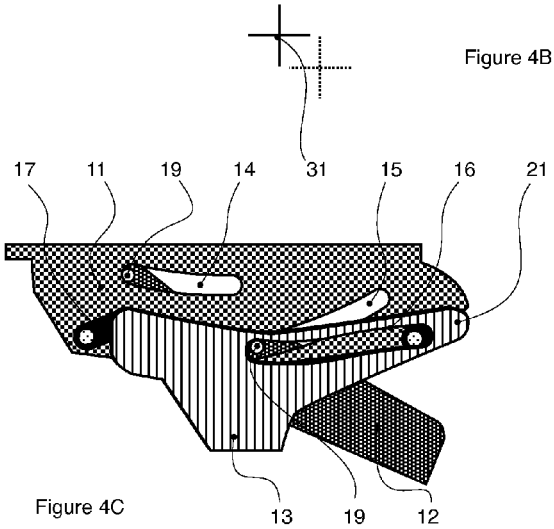

FIG. 3A shows principal elements as juxtaposed overlaid 3D layers or slices;

FIG. 3B shows the elements of FIG. 3A separated in an exploded view, with interconnections depicted by broken lines;

FIGS. 4A through 4C are a 2D version of the 3D FIGS. 3A and 3B schematics, in a progression from back upright to back recline positions;

More specifically . . . .

Figure 5A:
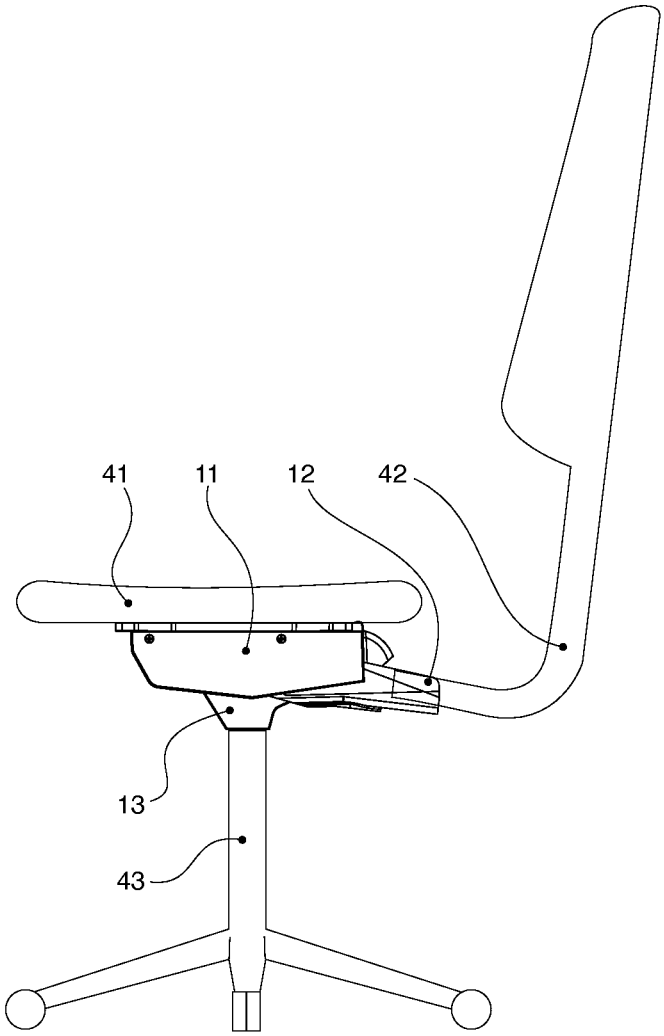

FIG. 4A depicts back upright with a drive frame largely level or horizontal, and a seat frame set downward and rearward upon an underpinning yoke frame;

FIG. 4B depicts a partial back recline, with drive frame canted downwards, and seat frame elevated with forward transition;

FIG. 4D depicts full back recline, with drive frame fully rotated clockwise, and seat frame fully elevated and forward;

FIG. 5 is a side elevation of a simplified version of an otherwise generic pedestal office or desk chair incorporating the mechanism of FIGS. 1A through 4D as a modular cartridge under-seat insert;

FIGS. 6 through 10 relate to the Appendix;

More specifically . . . .

Figure 6:
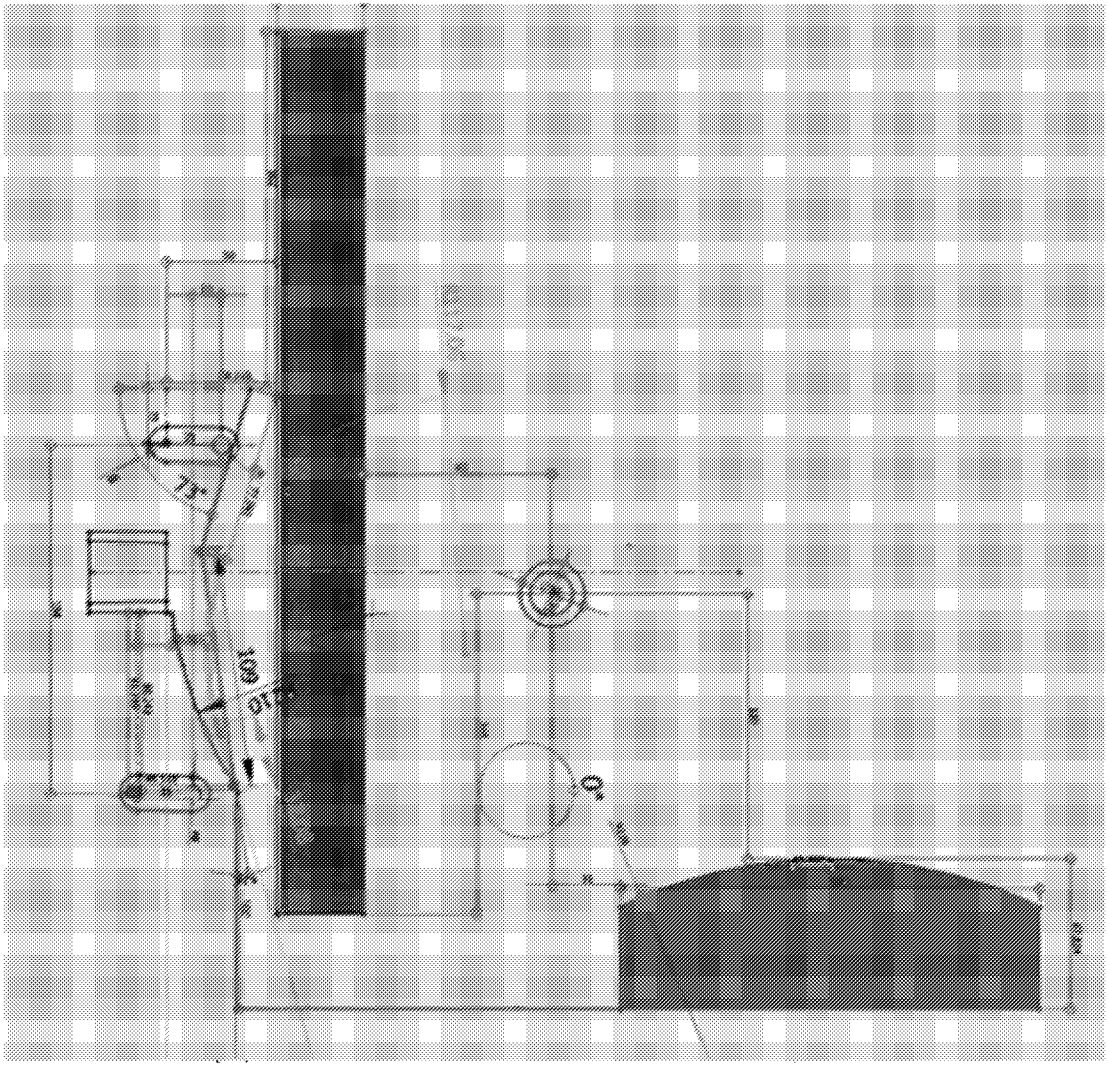
Figure 7:
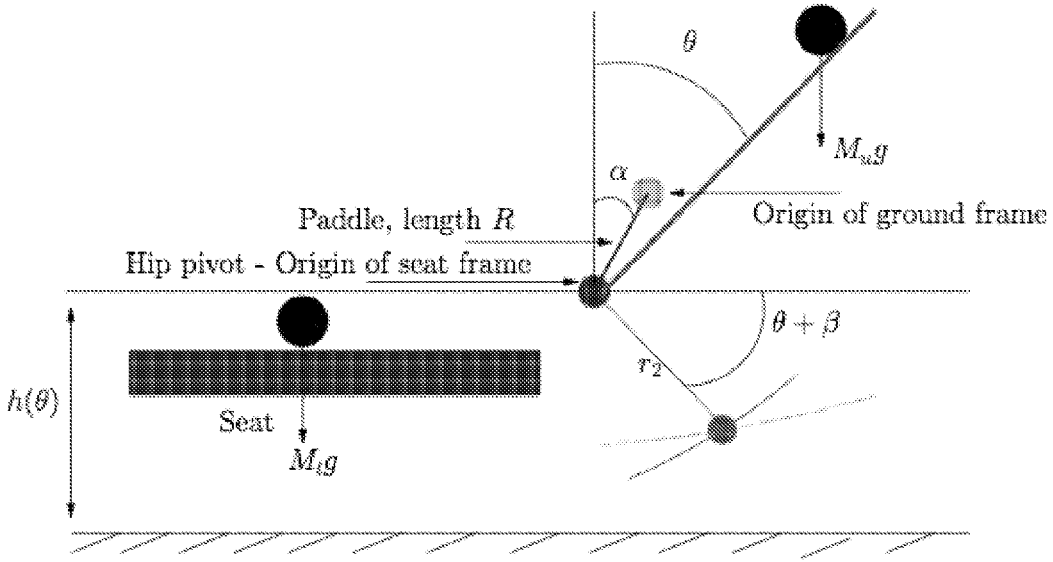
Figure 8:
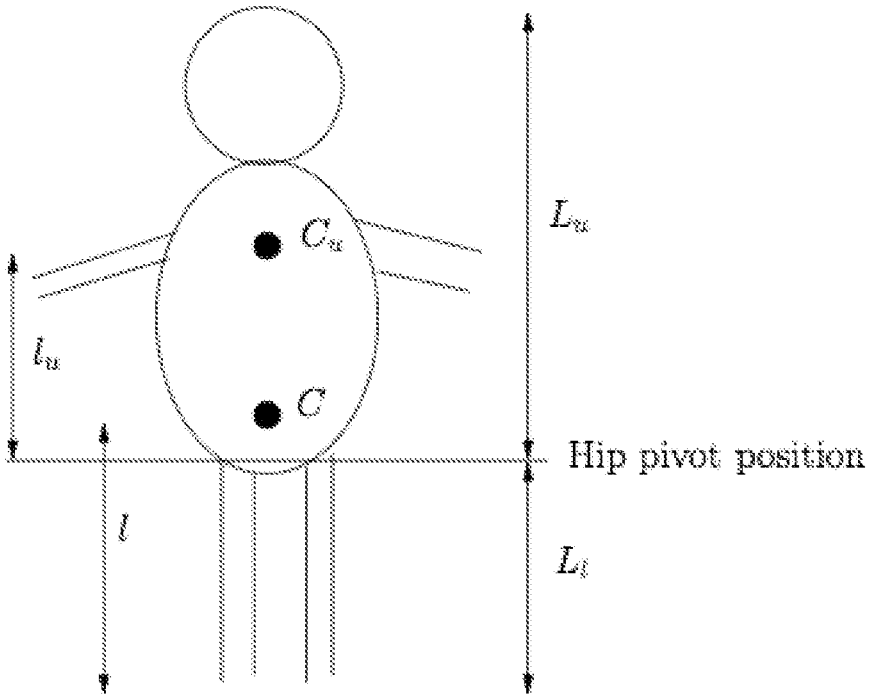
Figure 9:
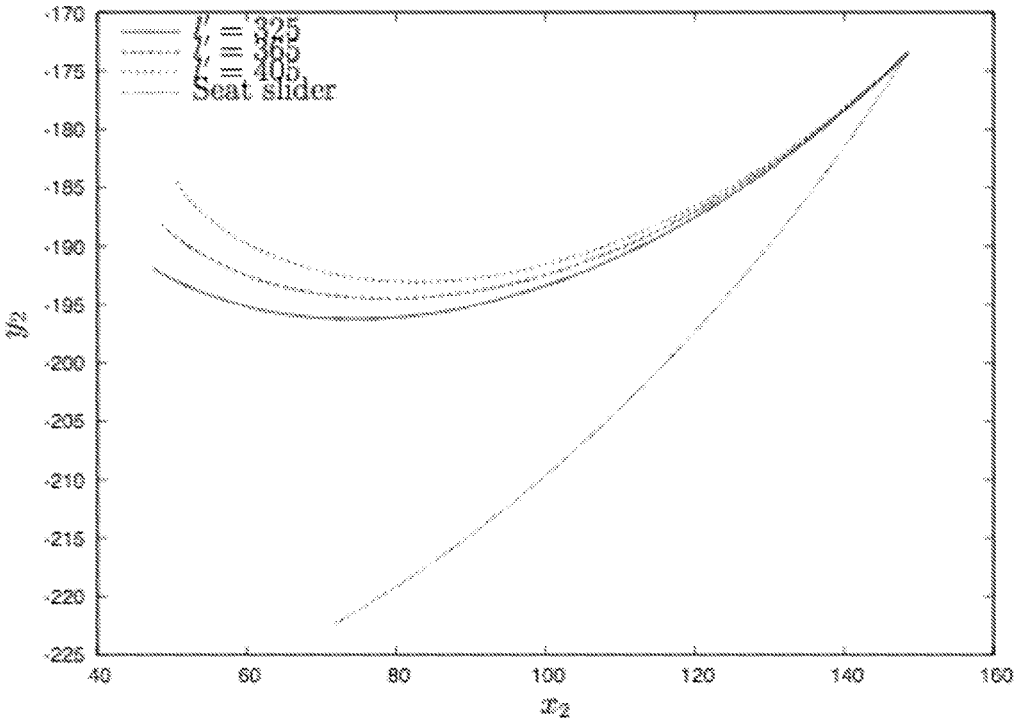
Figure 10:
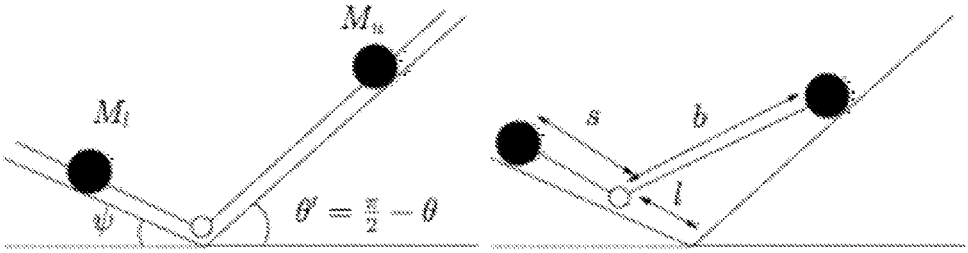

FIG. 6 shows a screen capture CAD map of an example chair as initial geometry;

FIG. 7 shows a simplified chair design geometry with parameters;

FIG. 8 shows a typical human occupant with relative lengths and positions of centre of mass;

FIG. 9 shows action performance curves;

FIG. 10 shows an occupant in chair with a tilting seat with (right) and without (left) slouching.

DETAILED DESCRIPTION OF THE INVENTION

Referring to the drawings . . . .

A chair action reflects, or is dictated by, a desired 'behaviour', such as an individual or collective element movement pathway in space, and occupant 'experience'. The pathway may be a 'special' curve in a particular disposition, i.e. position and orientation absolutely or in relation to other elements. Curve profile itself may be complex, such as of compound or 'spline' curvature, and/or 'subtle' in form to achieve and end result. A particular instance is locus of (translational) movement of an effective pivot centre of an action and/or chair occupant. In that regard, even modest curve transition discontinuities can have a major impact. Curvature can be expressed and derived mathematically from consideration of the movement of elements. Such profiles can be programmed by the physical contours of certain chair elements, such as guideway slots, which can be substituted for action change, rather in the manner of a punched card hardware program input.

Implementation is desirably with a minimal attendant mechanism complexity and component count. That is an 'optimised' or 'value-added' outcome. This is consistent with cost, serviceability and reliability considerations. Thus, say, every pivot or slide is a potential 'sticking point' or wear and ultimate failure vulnerability against motion freedom. Occupancy can be sensitive to chair action, without an occupant necessarily being aware or able to comprehend or analyse motion subtleties, but with an overall reassuring sense of ease/comfort or disconcerting unease.

A biomechanical commonality of user or occupancy experience over a wide occupancy weight range and one harmonious with a body natural pivot point, not necessarily constrained by the physical confines of chair mechanical elements, is a challenge of subtlety in action without undue complexity in mechanism.

An example of an enabling chair mechanism for a recliner pedestal chair features some three principal (frame) elements, namely a seat frame 11, a drive frame (or drive arm) 12 and a supporting or underpinning yoke frame 13. The frame elements 11, 12 and 13 are mutually inter-fitted or inter-nested for a compact format. Thus the seat 11 sits astride the drive arm 12, which in turn sits astride the yoke 13. Seat frame 11 features integral mounting lugs projecting from each upper corner for fitment of an upholstered seat cushion 41, such as depicted in FIG. 5.

Seat frame 11 linear translational slide motion up and/or down an effective notional ramp incline is driven by tilt recline action of chair occupant against a back 42 (such as shown in FIG. 5) connected to, or mounted upon, drive arm 12. Modest tilt, lift or drop of seat frame 11 can thus be introduced along with movement forward.

Ultimately, a frame assembly may need to react with a fixed frame of reference such as a ground plane; but within the frame assembly frames can react between themselves and so termed reaction frames to transfer a net movement.

Yoke 13 represents a primary frame, fitted to a chair pedestal 43 or other frame, and resides at a static core of the mechanism, serving as a mounting anchor and reaction point for the chair action, and as a primary or master reaction frame.

Interaction and movement of seat frame 11 and drive frame 12 relative to yoke frame 13 is controlled by a series of elongate profiled guideway slots 14, 15, 16 and respective followers 19 between frames. Slot 15 in seat frame 11 overlaps locally with slot 16 in yoke frame 13, with a common dual path follower 19. These allow for 'free-floating', rocking to-and-fro, tilt-recline action of the chair, whilst tethering the motion to follow rotation about a common virtual pivot (VP) point 31.

Around and upon underpinning yoke frame 13 is fitted a seat frame 11, with a horizontal platform plate, for affixing a seat cushion 41, pad or similar, and depending side walls 24 either side of the yoke. Each wall features two guideway slots. A forward guideway slot 14 to interact with follower 19 on drive frame 12 and a rearward guideway slot 15 to interact with a follower 16 on yoke frame 13, as well as follower 19 of drive frame 12. The span and profile of the guideways determine the chair recline action.

The guideway slots 14, 15, 16 and followers 19 act in conjunction with swing arms or pivot links 17, 18 mounted upon pivot bearings 21, at opposite ends of yoke frame 13 and seat frame 11.

Bias springs 22 interact between frames to provide prescribed (progressive) resistance and return chair action over the action travel range.

An end and side cover plate 41 shields the internal mechanism to prevents finger trap or interference with the mechanism. Demountable side cover plates (not shown) may also be fitted to that end.

Construction

1. A seat frame 11, such as one of inverted 'U' or 'C' section, with opposite side walls depending from a top plate or platform;
2. a drive frame 12, such as one of 'U' or 'C' section, with opposite side wall up-stands spaced to embrace seat side walls;
3. a yoke frame 13, with opposite side faces interposed between respective seat frame and drive arm side plates;
4. mutually offset longitudinally overlapping pair elongate curved slots 14, 16 in seat frame side walls;
5. followers, such as rollers 19, carried by drive arm 12 side walls and located within yoke slots 14, 15;
6. an intermediate curved elongate slot 16 in yoke frame 13 arm, with marginal overlap with some seat frame slots 14, 15;
7. a follower 19 carried by the drive arm 12 also being located in the yoke frame slot 16;
8. pivot arms or swing links 17, 18 between opposite ends of seat frame 11 and yoke frame 13;
9. to allow seat frame rock upon the yoke frame 13, under command of the drive arm 12;
10. demountable side cover plates to inhibit (finger trap hazard) access to the assembly.

For ease of manufacture, the seat and drive frames 11, 12 lend themselves to pressing, stamping, sub-assembly fabrication, moulding or casting. Yoke frame 13 is conveniently a single casting, but could have bifurcated or split side arms from a common central stem. Yoke frame wall depth is sufficient to carry and locate a transverse roller or traveller 19 within a guideway slot 14, 15. Swing arm or pivot link end bearings 21, if not the arms 17 themselves, could also be contained within profiled cut-outs in the depending seat frame wall depth. A seat frame 11 can be integrated with a load spreader platform, say as a unitary moulding. Yoke 13 arms can protrude through a cut-out in what would otherwise be the floor of the drive frame 12 to sit within the embrace of opposed depending seat frame 11 side walls.

Drive frame 12 is free to articulate about followers 19 located in seat frame guideway slots 14, 15 and to 'plunge' or 'dive' forward and upward at its forward (seat inboard) end, upon mounted back frame 42 tilt or recline. In doing so, seat frame 11 itself is urged forwards and upwards, rocking upon or about pivot links 17, 18 about the yoke frame in a free-floating mobility action. Overall, a form of dual overlaid mobility is achieved between seat 11 and back 42, as drive frame 12 and seat frame 11 interact individually in different respective ways or modes with the underpinning yoke frame 13, albeit the a through-tie or intervention roller follower 19 in yoke slot 16.

A swing arm 17, 18 mode between seat 11 and yoke 13 admits a modest constrained 'to and fro', fore and aft rocking, with or without tilt according to the relative lengths of fore and aft link pairs 21. A slide mode between drive arm 12 followers 19 and fore and aft seat slots 14, 15 admits a greater range of back recline than the rocking throw of the swing arms 17, 18, having a more distributed or protracted impact upon seat 11 translation, with or without change in seat inclination. In simplistic terms, links introduce greater 'discipline' in geometry, albeit with attendant inflexibility, whereas slides are relatively 'undisciplined', but with greater freedom and flexibility to accommodate motion uncertainty or 'fudge'.

Each mode engenders a particular occupancy sensation or experience, which can be overlaid and blended with another, for perceived freedom yet stability and control. The modes or roles themselves might be adapted, mixed or interchanged.

Forward translation or slide of the seat 11 accompanies backward tilt of the back 42. Thus, say, for a pedestal chair, an occupant experiences an unchanged (desk) access or (desktop) viewing angle, perception, presentation or access stance, upon leaning back. That is the occupant body as a whole moves forward a compensatory amount as the occupant head moves back. The seat can also tilt at or about either front or rear edges or some intermediate point or locus.

The length or longitudinal span of guideway slots 14, their relative disposition and the travel arcs of the pivot links 17, 18 and their pivot 21 dispositions collectively determine overall range of travel. Similarly with the difference in height between guideway slot ends in determining any vertical component of travel. Changing the relative throws of forward and/or rearward links allows adjustment of seat inclination change over the translational travel range. Complex curvatures can give subtle motion performance changes. Abrupt transitions and even discontinuities can be included to offer local resistance. In practice it is found that the geometry can prove very sensitive, 'peaky', or volatile in reaction of motion path profile to changes in pivot link geometry. A solid modelling CAD/CAM program can be used empirically to map the effect of changes. Thus, say, a VP constraint could be imposed upon individual element and chair occupant mobility.

An adjustable travel limit stop, such as an abutment in a slot 14, may be fitted to curtail the range of back tilt. Effective pivot centres and loci of movement can be established for each set, e.g. pair, of interacting elements and a roller followers and link pivot bearings are contrived to hold the elements carried marginally apart at an operating clearance or tolerance transversely of the pivot or slide axis, so juxtaposed faces of elements need not be in contact, but if, or in case they are, surface layer bearing sheets or coatings, such as PTFE, or local chafing strakes can be fitted.

The elements themselves could be fabricated in whole or in part from synthetic plastics materials, such as self-lubricating engineering grade nylon, polyethylene, polyester or polyamide.

Mutual containment of elements, one largely within the confines of another both vertically and longitudinally, along with modest overall longitudinal span and depth contribute to a compact mechanism which can fit underneath a chair seat. The inter-couple(s) of elements, such as links or followers, are also contained within their mutual embrace or inter-fit In that sense, the compact mechanism could be regarded as 'internalised' to a core chair module. Other (relatively) 'external' chair components, such as a rearward offset back upstand can mount to or inter-couple with the mechanism, say from one side.

Work done or input plotted against the seat movement or output can be expressed as a 'potential energy function'. A level or flat curve or plot represents an even or neutral action. An upward 'hump' or peak represents additional input for a given displacement, so effectively an obstruction to or loading bias against movement. A modest counteraction or resistance may be introduced at the start of back tilt, to inhibit inadvertent sudden movement. A modest spring or return bias can be introduced through springs operative between seat and drive or yoke frames. The spring mounting can be adjustable, or a fixed upon installation, as a 'universal' (one pre-tension to suit all prospective occupancy) bias setting.

Empirical data suggests that a virtual pivot point, representing the natural human hinge or hip joint can be emulated by a mechanism for a wide range (if not all) heights and masses. Realisation of an ambition for a chair that will be comfortable for anybody to use, with a chair movement that ensures complete contact and support during recline a mathematical formula has been developed, giving consideration to percentile height and weight differentials against a virtual pivot point. The need for elaborate seat adjustments can be dispensed with for a fundamental chair action in better conformity with occupancy.

Component List

11 seat frame
12 drive frame
13 yoke frame
14 (seat frame front) guideway slot
15 (seat frame rear) guideway slot
16 (yoke) guideway slot
17 front swing arm/pivot link
18 rear swing arm/pivot link
19 follower
21 pivot bearing
22 return bias spring
31 'Virtual Pivot'41 seat cushion
42 back mounting arm
43 pedestal base

APPENDIX

1.1 Background

Sitting in Office Swivel chairs is a common experience; most have a wide array of adjustments to enable each user to set them up to their individual preference. As a chair reclines normally a series of springs resist motion. An intuitive solution has been developed according to some aspects of the present invention to make the experience more comfortable by using the occupant's mass to resist motion, rather than springs, but its effectiveness is difficult to quantify. That is, when sitting and leaning back the occupant's mass balances with the force applied to the chair back by raising the seat, as opposed to the traditional approach of compression springs. In addition, the movement of the seat acts as if there was a virtual pivot, which represents the natural human hinge point, the hip, and ensures complete contact/support for the occupant during the reclining cycle with associated back support benefits. One ambition is to contrive a chair with a minimum of adjustments that will be comfortable for anybody to use. Empirical data suggests that the mechanism achieving this works for a wide range of heights and masses, subject to a more rigorous analysis. A challenge is to develop a model be to consider what Human percentile will receive the same effect as they recline and return to neutral rest; to consider if the current geometric set-up is a true reflection of the forces in play, and if this geometry be altered to achieve a more efficient result.

There are also frictional forces in the mechanism to consider; their interaction with the process needs to be better understood, allowing for alteration during manufacture. Consequently, it is useful to determine if controls could be added to the chair to increase, or decrease, the effects experienced by the occupant in a desirable way i.e. by altering friction or the geometry of the mechanism. 'Core Stability' can be improved by making the occupant work to return to an upright position, so it is not necessarily true that the best chair is one where the least effort is required).

1.2 Problem Challenge

To determine if a chair design can be adapted, so that a sitter or occupant pivots at or about their hip and remains neutrally stable as they recline in the chair.

2 Designing a Neutrally Stable Chair

FIG. 6 shows an initial chair geometry under consideration. The chair back and seat both move relative to the ground and fixed components of the chair. They are all connected via a system of sliders that couple the motion of the chair back and seat. As the person on the chair (the 'sitter' or occupant) reclines, this mechanism causes the seat to rise in such a way that the seat remains horizontal, and that the sitter pivots at their natural pivot point, the hip. In FIG. 6, certain parts of the mechanism are fixed relative to the ground, some are fixed relative the chair back and others are fixed relative to the seat. As an occupant reclines, the back mechanism under the seat moves along the sliders, which are fixed relative to the ground and seat respectively. As the co-incident point between the sliders moves, the angle of the 'paddles' (the stadium shaped devices beneath the seat) must change and this movement raises the seat whilst keeping it horizontal; it also induces a horizontal translation.

The hip pivot of the sitter, shown as concentric circles in the middle of FIG. 6, is intended to remain in the same place throughout the recline of the chair back. This is achieved through the choice of shape of the sliders, ensuring that the relative motions of the back and seat are related in the correct way. This is not perfectly realised at present due to other design constraints, but it is very close. In starting point chair design, the curves are the arc of a circle and a straight line. The challenge is how to choose a curve, within this existing chair design, to achieve a neutrally stable chair where sitter or occupant keeps the same potential energy for all reclining angles, as well as pivoting about their hip.

To ensure that the virtual pivot is at the hip throughout the recline, and for mathematical simplicity, in the analysis that follows it is assumed that both the curves are arcs of a circle. With this simplified design both paddles are identical and only one need be considered if the intention is to keep the seat horizontal. Seat tilt this can be introduced with by different design paddles (tilt is discussed briefly in Section 5). Also for mathematical simplicity, without loss of generality, it can be assumed that the paddle is located at the hip pivot point. A simplified chair geometry is shown in FIG. 7. It is additionally assumed that a seated person or occupant can be represented by two centres of mass; one upper-body mass, located a distance Iu from the hip (pivot point) and the other, lower-body mass located a distance Il from the pivot. The total mass of the sitter M is divided into an upper-body mass Mu and a lower-body mass Ml. Details of the range of typical values of these are discussed in Section 3. The angle of recline of the back is given by $\theta$, with $\theta=0$ corresponding to the sitter being upright.

The various chair design parameters marked on FIG. 7 are: R, the length of the paddle, $\alpha$, the angle the paddle makes with the vertical, $r_2$, the radius of the circular arc that the chair back runs along (the blue curve), $\beta$, the angle below the horizontal of the start of the circular arc when the chair is upright, and $h(\theta)$, the height of the sitter's hip above the ground. When the chair is upright at $\theta=0$, the initial paddle angle is taken to be $\alpha=\alpha_0$.

FIG. 7 shows a simplified chair design with parameters. As the chair reclines and $\theta$ increases the red point moves along the two sliders (green and blue). This causes the paddle to rotate and, as $\alpha$ changes, the seat height changes.

For a starting point chair design these values are approximately given by . . .

$$R = 25 \text{ mm},$$

$$\alpha_0 = 0,$$

$$r_2 = 210 \text{ mm},$$

$$\beta = \frac{\pi}{4},$$

although $\beta$ may well be somewhat larger in reality.

An objective is to try and find a suitable curve that makes the chair neutrally stable.

The potential energy of the sitter with reference to the origin of the ground frame, is given by . . .

$$PE = Mgh + M_u g l_u \cos\theta$$

$$= Mg(h + l')\cos\theta$$

where the parameter $$l' = \frac{M_u}{M} l_u$$

is person dependent. Ranges of values of l' are discussed in Section 3. An aim is for a given person with characteristic l', to find the curve such that . . .

$$h + l' \cos\theta = h_0,$$

where $h_0$ is a constant related to the initial potential energy of the sitter.

Two coordinate systems are introduced; one fixed to the ground, given by (x, y), and one fixed to the seat, given by (X, Y). Their origins are as given in FIG. 7 and the two coordinate systems are related by . . .

$$x = X - R\sin(\alpha),$$

$$y = Y - R\cos(\alpha),$$

where $\alpha$ is the angle made by the paddle to the vertical and the height of the seat relative to the ground h is given by $$h = -R\cos(\alpha)$$

As it is assumed that the two sliders the chair runs along are both arcs of the same circle, only one of them need be considered and, relative to the seat coordinates (centred at the hip), the curve is given in parametric form by . . .

$$X_2=r_2\cos(\theta+\beta)$$

$$Y_2=-r_2\sin(\theta+\beta)$$

or $$x_2=r_2\cos(\theta+\beta)-R\sin\alpha,$$

$$y_2=-r_2\sin(\theta+\beta)-R\cos\alpha,$$

relative to the ground. A potential energy constraint that requires . . .

$$-R\cos\alpha + :'\cos\theta = h_0$$
$$= l' - R\cos\alpha_0$$

It is therefore known how the paddle must move to maintain a constant potential energy and this implies . . .

$$R\cos\alpha = R\cos\alpha_0 - l'(1-\cos\theta),$$
$$R\sin\alpha = \sqrt{R^2-(R\cos\alpha_0+l'(\cos\theta-1))^2}$$

Combining the above produces a parametric equation for the curve as . . .

$$x_2=r_2\cos(\theta+\beta)-\sqrt{R^2-(R\cos\alpha_0+l'(\cos\theta-1))^2} \quad (1)$$

$$y_2=-r_2\sin(\theta+\beta)-R\cos\alpha_0+l'(1-\cos\theta) \quad (2)$$

This is the equation of the curve required, for a person with characteristic I'. Depending on the parameters involved the square root on the righthand side of (1) could become complex. This corresponds physically to the chair being unable to lift the sitter enough to maintain a constant potential energy. The design will need to ensure R is large enough for the range of I' values of interest such that this square root always remains real.

As R is small compared to I' and $r_2$ it is expected that (1)-(2) are approximately equivalent to . . .

$$x_2\approx r_2\cos(\theta+\beta),$$

$$y_2\approx -r_2\sin(\theta+\beta)+l'(1-\cos\theta).$$

It can be shown that this corresponds to the arc of an ellipse.

3 Human Data

FIG. 8 shows a typical human showing the relative lengths and positions of centre of mass. $I_u$ is the height of the upper body centre of mass $C_u$ and I is the height above the ground of the whole body centre of mass C.

To determine behaviour of the chair it is needed to find the range of I' values that are typical in the population. The aim is that the chair will behave similarly for all users, regardless of shape and size, and that all users can obtain the same experience from the chair with the minimum of adjustment. The analysis above suggests that the neutrally stable curve given by (1)-(2) is person dependent. In a simplified model of a human it is needed to determine the position of the centre of mass of the upper body and how the typical mass is distributed between upper and lower body. General population data is quite hard to find, and the sources uncovered were all seemingly based on the same data set given in the FAA Human Factors Design Guide [1]. This gives average distributions of mass and location of centre of mass as a proportion of height. Also found are ranges of data measuring relative body lengths as part of the NASA manned system standards [2]. A further data set is to be found in [3], but is based on measurement of US marines and so may be less representative of the population as a whole.

The total body length is taken as by $L=L_u+L_l$, where $L_u$ and $L_l$ are the lengths of the upper and lower body respectively. Similarly the total mass is taken as $M+M_u+M_l$, where $M_u$ and $M_l$ are the mass of the upper and lower body respectively. T these measurements are shown in FIG. 8 and, according to the data, are given as . . .

$$M_u = \frac{2}{3}M$$

$$M_l = \frac{1}{3}M$$

Position of COM of whole body $C=0.55\ (L_l+L_u)$

Position of COM of upper body $$l_u = \begin{cases} 0.66L_u \text{ armless,} \\ 0.61Lu \text{ with arms at sides.} \end{cases}$$

$$L_u = \begin{cases} 914 \text{ mm average male.Range 855-972(5-95}th\text{ percentile)} \\ 851 \text{ mm average female.Range 795-910 mm (5-95}th\text{ percentile)} \end{cases}$$

It should be noted that these upper body lengths $L_u$ relate to the height above a seat when sitting, rather than a definition which is height above the virtual pivot point, roughly the hip. This reduces our effective $L_u$ by around 50 mm. Also ignored is the complication of arm position by assuming the armless value of $I_u$. The parameter important for chair calculations is given by . . .

$$l_u = \frac{M_u}{M}l_u$$
$$= \frac{2}{3}0.66L_u,$$

This gives a range from around I'=325 to I'=405 to cover the 5th to 95th percentile of both male and female sitters.

4 Sample Curves

FIG. 9 shows required curves for varying I' values compared to the arc of the seat slider for the chair in an upright θ=0 position.

This information can now be used to predict the ideal curves to achieve a neutrally stable seat. A curve is given by (1)-(2). We will keep the existing chair design parameters and as such it is taken that R=25 mm, $\alpha_0=0$, $r_2=210$ mm and if is also assumed that $\beta=\pi/4$ (although in reality it is somewhat larger than this on the plans considered during the study group). The required curves to achieve neutral stability are shown in FIG. 4. It has been that assumed a maximum tilt of θ=25°. Three cases are presented, I'=325 corresponding to the smallest female within our range of interest, I'=365, an average adult user, and I'=405 for the largest male user. The arc of the circle fixed with the seat is also shown for comparison. Notably, the difference between each of these curves is not large.

The 'perfect' or optimised curve to ensure neutral stability changes depending on the sitter. Given that one of the overall aims of the current seat design is to try and ensure all users have a similar experience of using the chair without having to make a myriad of adjustments it is of note how much difference there is in the potential energy change for a sitter on a seat optimised for a different users. If a seat is 'perfect' for a sitter with a characteristic $\hat{l}'$, the question arises of how it behaves for different user with characteristic I' and mass M. In this case the change in potential energy [PE] of the sitter as the seat reclines is given by . . .

$$[PE]=(l'-\hat{l}')(1-\cos\theta)Mg$$

as the seat reclines and θ increases.

5 Some Considerations on Seat Tilt

FIG. 10 shows an occupant in a chair with a tilting seat with (right) and without (left) slouching.

One factor is whether or not tilting of the seat was desirable. Experiments to examine how performance when friction between the sitter and the seat is removed (or at least reduced) reveal difficulty in staying on the seat if it always remains horizontal. This leads to considerations of what angle the seat needed to raise to in order to avoid this tendency to slip or slouch in the chair.

The following is briefly to consider a much simpler, more abstract design to investigate the importance of seat tilt; this is set out in FIG. 5. For this purpose it is again assumed that the sitter can be represented by two point masses joined through a pivot located at the hip. The legs are replaced by a point mass Ml located a distance s from the hip and the body is replaced by a point mass Mu located a distance b from the hip. It is assumed that contact between the sitter and the chair only occurs at the centre of masses. If the sitter slouches, their hip moves from the corner and translates along the seat a distance I. To avoid slouching it is necessary to ensure that the hip remains at the corner of the chair back and seat. The potential energy of the sitter is given by . . .

$$\frac{V}{g}=(s+l)M_l\sin\psi+\left(-l\cos(\theta'+\psi)+\sqrt{l^2}\cos^2(\theta'+\psi)+b^2-l_2\right)M_u\sin\theta'\sim$$

$$\text{constant}+l(M_l\sin\psi-M_U\cos(\theta'+\psi)\sin\text{ theta}')\text{for}'\text{small}'l.$$

to avoid slouching we need to ensure that . . .

$$M_l\sin\psi>M_u\cos(\theta'+\psi)\sin\theta',$$

so that not slouching is the lowest energy state. If it is further assumed $M_l<<M_u$ (somewhat dubiously) $\cos(\pi/2-\theta+\psi)<0$ which implies $\psi>\theta$ to prevent slipping.

6 Other Factors to Consider

For a slightly simplified chair design a required shape or profile of 'mobility map' can be derived to ensure the chair is neutrally stable for a given sitter. This is not quite the whole picture as allowance also needs be made for the contribution of the chair parts (the potential energy of sitter being constant does not ensure the potential energy of the combined sitter and chair are constant). The most desirable design of chair for the general population can be considered, given that it can only be fine tuned for a fixed I' value. If the desire is to ensure the sitter has to work to return to the upright position, it may be desirable to ensure that the potential energy is reduced for all users during reclining and increases when the sitter returns to upright. There are many other things that could be of considered. These include:

Detailed Mechanics/'Feel' of Sitter on Chair (Difficulty of Indeterminate System with Friction)

The sitter or occupancy experience when sitting on and operating the chair. is a consideration. In particular, how in a given occupancy disposition the sitter applies forces to the back and seat of the chair to enable it to recline and how the sitter uses their own body weight or weight-shift to resist motion. Prototype experimentation clearly shows it is far harder to recline the chair with an occupant's feet off the ground. The underlying ground serves as a convenient reaction plane to an occupant's feet. A simple approach to this is difficult to achieve as where the sitter applies the force on the chair back is a factor. There is also the added difficulty of friction between the sitter and the chair. Again experimentation with reducing this friction suggests that the forces applied by the sitter are dependent on this friction coefficient.

Effect of Friction in Sliders.

An important effect is the influence of friction in the sliders. Some friction is necessary in the sliders, because the movement of the chair should not be too easy or disconcerting, both for steadiness and comfort, and also for exercise. A similar consideration applies to bearings. The effect can be regarded as damping.

Allowance of Tilting of Seat Base on Constant PE Calculations.

The forgoing potential energy calculations were based on keeping the seat base horizontal, as in the supporting embodiment chair design. Yet some tilting (forward or backward) of the seat might be desirable. This could be achieved by have two paddles or arms of differing lengths (say) that cause the front and back of the seat to rise and fall by differing amounts, depending on the tilt required. The seat would thus effectively 'float' upon spaced arms. The potential energy calculations presented in section 2 could be extended to allow for two paddles and the subsequent tilting of the seat. The geometry and algebra would be harder but it should be feasible to find a suitable curve to ensure neutral stability.

REFERENCES

[1] Human Factors Design Guide. William J. Hughes Technical Centre, Federal Aviation Administration, 1996.

[2] Man-Systems Integration Standards: Volume I NASA-STD-3000 Revision B, NASA, 1995.

[3] Sarah M. Donelson and Claire C. Gordon, Matched Anthropometric Database of U.S. Marine Corps Personnel: Summary Statistics Natick Research, Development and Engineering Centre Technical Report, 1995.

SEQUENCE LISTING

Not applicable.

The invention claimed is:

1. A subassembly for a chair of the type including a separate seat and back which are adjustable among a plurality of positions, and a chair frame for supporting the seat and back above a surface, the subassembly comprising a seat frame for supporting the chair seat, a drive frame connectable to the chair back, an inter-couple between the seat and drive frames, a yoke frame for chair mounting, and another inter-couple between the seat and yoke frames, wherein the drive frame is freely slidably moveable relative to each of the seat frame and the yoke frame along a predefined path so as to simultaneously effect corresponding movement of the seat frame relative to each of the drive frame and yoke frame.

2. The subassembly of claim 1, wherein: the inter-couple between the seat and drive frames comprises at least one guideway provided on one of the seat and drive frames, the at least one guideway defining the predefined path, and at least one follower provided on the other of the seat and drive frames, at least one follower disposed in each at least one guideway; and wherein the drive frame is freely slidably moveable relative to each of the seat frame and the yoke frame along a path defined by the at least one guideway so as to simultaneously effect corresponding movement of the seat frame relative to each of the drive frame and yoke frame.

3. The subassembly of claim 2, wherein: the inter-couple between the seat and drive frames comprises at least two guideways provided on one of the seat and drive frames, and at least two followers provided on the other of the seat and drive frames, one of the at least two followers disposed in each of the at least two guideways; and the drive frame is freely slidably moveable relative to each of the seat frame and the yoke frame along a path defined by the at least two guideways so as to simultaneously effect corresponding movement of the seat frame relative to each of the drive frame and yoke frame.

4. The subassembly of claim 1, wherein: the inter-couple between the seat and drive frames comprises at least two guideways provided on the seat frame, and at least two followers provided on the drive frame, at least one follower disposed in each of the at least two guideways; and the drive frame is freely slidably moveable relative to each of the seat frame and the yoke frame along a path defined by the at least two guideways to simultaneously effect corresponding movement of the seat frame relative to each of the drive frame and yoke frame.

5. The subassembly of claim 2, wherein: the inter-couple between the seat and yoke frames is characterized in that the seat frame is pivotally moveably connected to the yoke frame; the yoke frame includes at least one guideway therein, and is further connectable to the chair frame so as to be stationary relative to the seat frame and the drive frame during relative movement of the seat and drive frames; and the at least one guideway in the yoke frame overlaps with the at least one guideway of the inter-couple between the seat and drive frames, and the at least one follower disposed in the at least one guideway of the inter-couple between the seat and drive frames is also disposed in the at least one guideway in the yoke frame.

6. A chair comprising a separate seat and back which are adjustable among a plurality of positions, including a plurality of reclined positions of the back, and a chair frame for supporting the seat and back above a surface, the chair further comprising a subassembly including a seat frame for supporting the chair seat, a drive frame connectable to the chair back, an inter-couple between the seat and drive frames, a yoke frame for chair mounting, and another inter-couple between the seat and yoke frames, and wherein the drive frame is connected to the chair back, the yoke frame is connected to the chair frame so as to be stationary relative to the seat frame and the drive frame during relative movement of the seat and drive frames, and the seat frame supports the chair seat; and wherein further the drive frame is freely slidably moveable relative to each of the seat frame and the yoke frame along a predefined path so as to simultaneously effect corresponding movement of the seat frame relative to each of the drive frame and yoke frame.

7. The chair according to claim 6, wherein the chair is operable under a potential energy function the mass of a seated occupant in a proportional inter-relationship between back and seat recline movement.

8. The chair according to claim 6, wherein: the inter-couple between the seat and drive frames comprises at least one guideway provided on one of the seat and drive frames, the at least one guideway defining the predefined path, and at least one follower provided on the other of the seat and drive frames, at least one follower disposed in each at least one guideway; and wherein the drive frame is freely slidably moveable relative to each of the seat frame and the yoke frame along a path defined by the at least one guideway so as to simultaneously effect corresponding movement of the seat frame relative to each of the drive frame and yoke frame.

9. The chair according to claim 6, wherein: the inter-couple between the seat and drive frames comprises at least two guideways provided on one of the seat and drive frames, and at least two followers provided on the other of the seat and drive frames, one of the at least two followers disposed in each of the at least two guideways; and the drive frame is freely slidably moveable relative to each of the seat frame and the yoke frame along a path defined by the at least two guideways so as to simultaneously effect corresponding movement of the seat frame relative to each of the drive frame and yoke frame.

10. The chair according to claim 6, wherein: the inter-couple between the seat and drive frames comprises at least two guideways provided on the seat frame, and at least two followers provided on the drive frame, at least one follower disposed in each of the at least two guideways; and the drive frame is freely slidably moveable relative to each of the seat frame and the yoke frame along a path defined by the at least two guideways to simultaneously effect corresponding movement of the seat frame relative to each of the drive frame and yoke frame.

11. The chair according to claim 8, wherein: the inter-couple between the seat and yoke frames is characterized in that the seat frame is pivotally moveably connected to the yoke frame; the yoke frame includes at least one guideway therein, and is further connectable to the chair frame so as to be stationary relative to the seat frame and the drive frame during relative movement of the seat and drive frames; and the at least one guideway in the yoke frame overlaps with the at least one guideway of the inter-couple between the seat and drive frames, and the at least one follower disposed in the at least one guideway of the inter-couple between the seat and drive frames is also disposed in the at least one guideway in the yoke frame.

12. The chair according to claim 8, wherein, in movement of the chair back into any one of the plurality of reclined positions thereof by an occupant seated in the chair, the drive frame and seat frame are both simultaneously moveable relative to each other, and to the yoke frame, into any of a plurality of positions defined by the geometry of the at least one guideway of the inter-couple between the seat and drive frames, to thereby effect movement of the chair seat into a corresponding one of the plurality of positions thereof.

13. The chair according to claim 8, wherein the at least one guideway of the inter-couple between the seat and drive frames defines the arc of an imaginary circle the center of which lies outside of the area of the seat frame to define a virtual pivot point positioned proximate an area of a chair seat typically occupied by the hip of a person seated in the chair, and wherein, in adjustment of the position of the chair back by an occupant seated in the chair, the drive frame and seat frame are slidably moveable relative to each other about the virtual pivot point and into a plurality of positions defined by the geometry of the at least one guideway of the inter-couple between the seat and drive frames.

14. The chair according to claim 6, wherein the chair is further characterized in that, when an occupant is seated in the chair with the chair back in any of the plurality of reclined positions thereof, the relative positions of the chair seat and chair back distribute the mass of the seated occupant between the seat frame and the drive frame so that the chair back and chair seat are at least substantially balanced in a neutrally stable position.

15. The chair according to claim 6, wherein the chair is further characterized in that, when an occupant is seated in the chair with the chair back in any of the plurality of reclined positions thereof, the relative positions of the chair seat and chair back distribute the mass of the seated occupant between the seat frame and the drive frame so that, in each of the plurality of reclined positions, the occupant has substantially the same potential energy, which potential energy is a function of the occupant's position relative to the surface above which the chair is supported.

16. The chair according to claim 6, wherein the subassembly further comprises at least one spring which biases the chair to a fully upright position of the chair back.

* * * * *